US005706794A

United States Patent [19]

Neal

[11] Patent Number: 5,706,794

[45] Date of Patent: Jan. 13, 1998

[54] LEVER ACTION COMPOUND BOW

[76] Inventor: Frank A. Neal, 953 Apple Valley Rd., Lyons, Colo. 80540

[21] Appl. No.: 740,659

[22] Filed: Oct. 31, 1996

Related U.S. Application Data

[63] Continuation-in-part of Ser. No. 529,076, Sep. 15, 1995, abandoned.

[51] Int. Cl.[6] ..... F41B 5/10

[52] U.S. Cl. ..... 124/25.6; 124/23.1

[58] Field of Search ..... 124/23.1, 25.6, 124/86, 88, 900

[56] References Cited

U.S. PATENT DOCUMENTS

| | | | |
|---|---|---|---|
| 2,714,377 | 8/1955 | Mulkey | 124/23.1 |
| 4,183,345 | 1/1980 | Caldwell | 124/25.6 |
| 4,287,867 | 9/1981 | Islas | 124/25.6 |
| 4,781,168 | 11/1988 | Lester | 124/25.6 |
| 4,858,588 | 8/1989 | Bozek | 124/25.6 X |
| 5,150,699 | 9/1992 | Boissevain | 124/25.6 |
| 5,408,982 | 4/1995 | Doornenbal | 124/23.1 |
| 5,454,361 | 10/1995 | Bronnert | 124/23.1 |

*Primary Examiner*—John A. Ricci

[57] ABSTRACT

A lever action compound bow comprising: two rigid levers formed in an inverted V-shaped configuration with an outboard end, an inboard end and a curved region therebetween, a bow string being affixed to each outboard end and extending between each rigid lever; a handle being positioned between the two rigid levers, a bar extending from each end of the handle, the bars being rotatably coupled adjacent to the inboard end of each rigid lever; and a stabilizing lever with two ends being rotatably coupled to the handle, elongated coupling devices operatively coupling an end of the stabilizing lever to the inboard end of a rigid lever, a forward force being generated by drawing the bow.

13 Claims, 4 Drawing Sheets

LEVER ACTION COMPOUND BOW

BACKGROUND OF THE INVENTION

1. Background Information

The present application is a continuation-in-part of a application filed Sep. 15, 1995 under Ser. No. 08/529,076, now abandoned.

2. Field of the Invention

The present invention relates to a lever action compound bow and more particularly pertains to utilizing the lever of the apparatus to reduce the tension level when drawing the bow string.

DESCRIPTION OF THE PRIOR ART

The use of archery bows shooting arrows by utilizing the apparatus in the suggested manner is known in the prior art. More specifically, archery bows heretofore devised and utilized for the purpose of shooting arrows by utilizing the apparatus in the suggested manner are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,174,268 to Martin a compound archery bow.

U.S. Pat. No. 4,739,744 to Nurney discloses a high energy limb tip cam pulley archery bow.

U.S. Pat. No. 4,246,883 to Ash discloses an archery bow with bow limb cocking mechanism.

U.S. Pat. No. 3,744,473 to Nishioka discloses a composite archery bow with bow limb tension control device.

U.S. Pat. No. 5,307,787 to LaBorde discloses a compound bow having offset cable anchor.

Lastly, U.S. Pat. No. 5,211,155 to Zamojski discloses an eccentric pulley mechanism for compound archery bow.

In this respect, the lever action compound bow according to the present invention substantially departs from the conventional concepts and designs of the prior art, and in doing so provides an apparatus primarily developed for the purpose of utilizing the lever of the apparatus to reduce the tension level when drawing the bow string.

Therefore, it can be appreciated that there exists a continuing need for a new and improved lever action compound bow which can be used for utilizing the lever of the apparatus to reduce the tension level when drawing the bow string. In this regard, the present invention substantially fulfills this need.

SUMMARY OF THE INVENTION

In view of the foregoing disadvantages inherent in the known types of archery bows shooting arrows by utilizing the apparatus in the suggested manner now present in the prior art, the present invention provides an improved lever action compound bow. As such, the general purpose of the present invention, which will be described subsequently in greater detail, is to provide a new and improved lever action compound bow and method which has all the advantages of the prior art and none of the disadvantages.

To attain this, the present invention essentially comprises a new and improved lever action compound bow comprising, in combination: two rigid levers, each rigid lever being fabricated of a rigid material and formed in a generally inverted V-shaped configuration with an outboard end, an inboard end and a curved region therebetween, each outboard end including opposing recessed notches, each inboard end including an associated pivot pin, a pair of opposing semicircular projections extending from each rigid lever between the curved region and inboard end, two cams being formed in a planar generally oval configuration and pivotally coupled between the semicircular projections of each rigid lever, a bow string formed in an elongated configuration and including two ends formed as loops, each loop being coupled within the recessed notches of the tip of each rigid lever, the bow string extending across and between each rigid lever; a handle formed in a curved generally cylindrical configuration with two ends, the handle including a front surface and a rear surface and being positioned at the approximate centerpoint of the two rigid levers, each end of the rear surface of the handle including a planar rectangular shaped rear bar extending therefrom, each end of the front surface of the handle including a planar rectangular shaped front bar extending therefrom, each rear bar including an outer end with a spine extending therefrom, each spine including an aperture extending therethrough, each front bar having an outer end coupled to the rotatably mounted cams of the apparatus, the handle including a planar generally triangular shaped bracket extending from its front surface, the apex of the bracket including an aperture extending therethrough, in an operative orientation the user grasping the handle and drawing the bow string rearwardly with an arrow; two fixed cables, each fixed cable having a first end affixed to the spine of a rear bar and a second end affixed to an inboard end of each rigid lever, the fixed cables stabilizing the apparatus when drawing the bow; and a stabilizing lever formed in a planar generally rectangular configuration, the stabilizing lever having its approximate center point rotatably coupled to the apex of the bracket, the stabilizing lever including two rounded ends, two hollow tubes each having a first end coupled with respect to a pivot pin at the stabilizing lever, each hollow tube having a second end coupled with respect to a pivot pin at the inboard end of a rigid lever, a forward force being generated by grasping the handle and drawing the bow string rearwardly, the forward force causing rotation of the stabilizing lever thereby shifting the outboard end of the rigid levers rearwardly.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved lever action compound bow which has all of the advantages of the prior art archery bows shooting arrows by utilizing the apparatus in the suggested manner and none of the disadvantages.

It is another object of the present invention to provide a new and improved lever action compound bow which may be easily and efficiently manufactured and marketed.

It is further object of the present invention to provide a new and improved lever action compound bow which is of durable and reliable constructions.

An even further object of the present invention is to provide a new and improved lever action compound bow which is susceptible of a low cost of manufacture with regard to both materials and labor, and which accordingly is then susceptible of low prices of sale to the consuming public, thereby making such lever action compound bow economically available to the buying public.

Still yet another object of the present invention is to provide a new and improved lever action compound bow which provides in the apparatuses and methods of the prior art some of the advantages thereof, while simultaneously overcoming some of the disadvantages normally associated therewith.

Still another object of the present invention is to utilize the lever of the apparatus to reduce the tension level when drawing the bow string.

Lastly, it is an object of the present invention to provide a lever action compound bow comprising: two rigid levers formed in an inverted V-shaped configuration with an outboard end, an inboard end and a curved region therebetween, a bow string being affixed to each outboard end and extending between each rigid lever; a handle being positioned between the two rigid levers, a bar extending from each end of the handle, the bars being rotatably coupled adjacent to the inboard end of each rigid lever; and a stabilizing lever with two ends being rotatably coupled to the handle, elongated coupling devices operatively coupling an end of the stabilizing lever to the inboard end of a rigid lever, a forward force being generated by drawing the bow.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
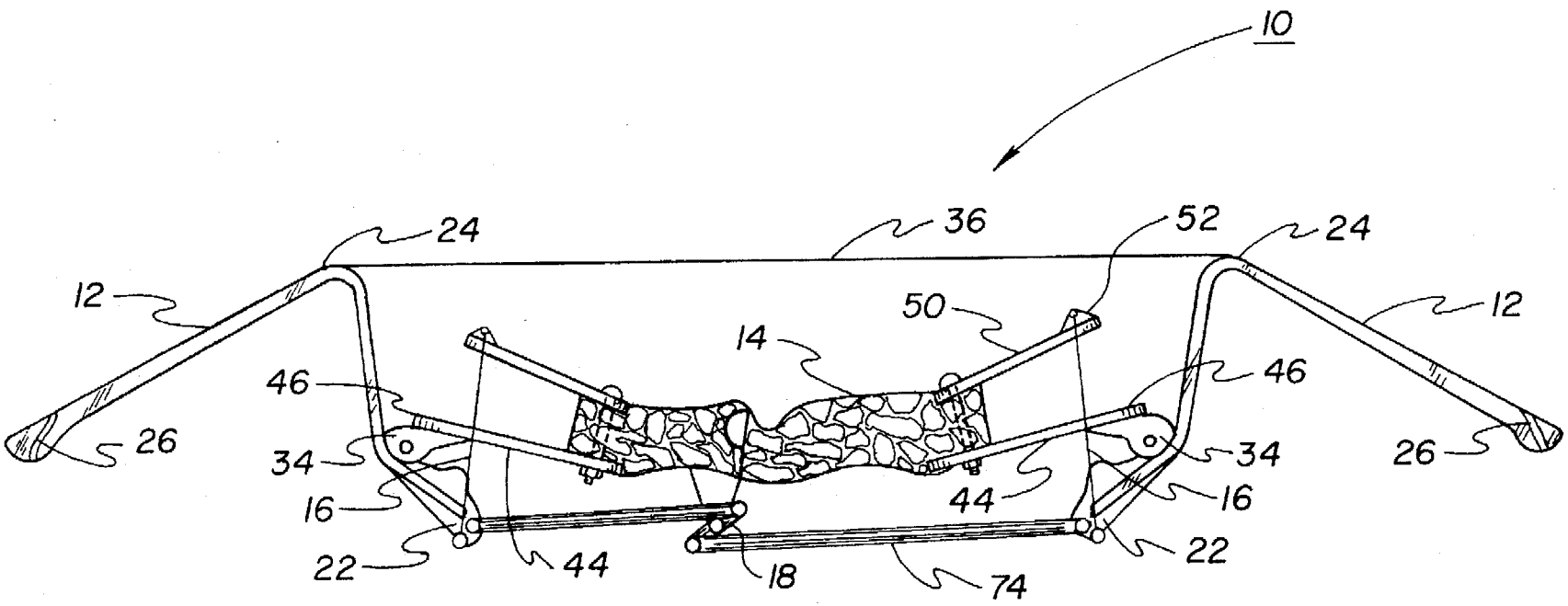
FIG. 1 is a perspective view of the preferred embodiment the lever action compound bow constructed in accordance with the principles of the present invention.

With reference now to the drawings, and in particular to FIG. 1 thereof, the preferred embodiment of the new and improved lever action compound bow embodying the principles and concepts of the present invention and generally designated by the reference numeral 10 will be described.

The present invention, the lever action compound bow 10 is comprised of a plurality of components such components in their broadest context include two rigid levers 12, a handle 14, two short fixed cables 16 and a stabilizing lever 18. Such components are individually configured and correlated with respect to each other so as to attain the desired objective.

Figure 4:
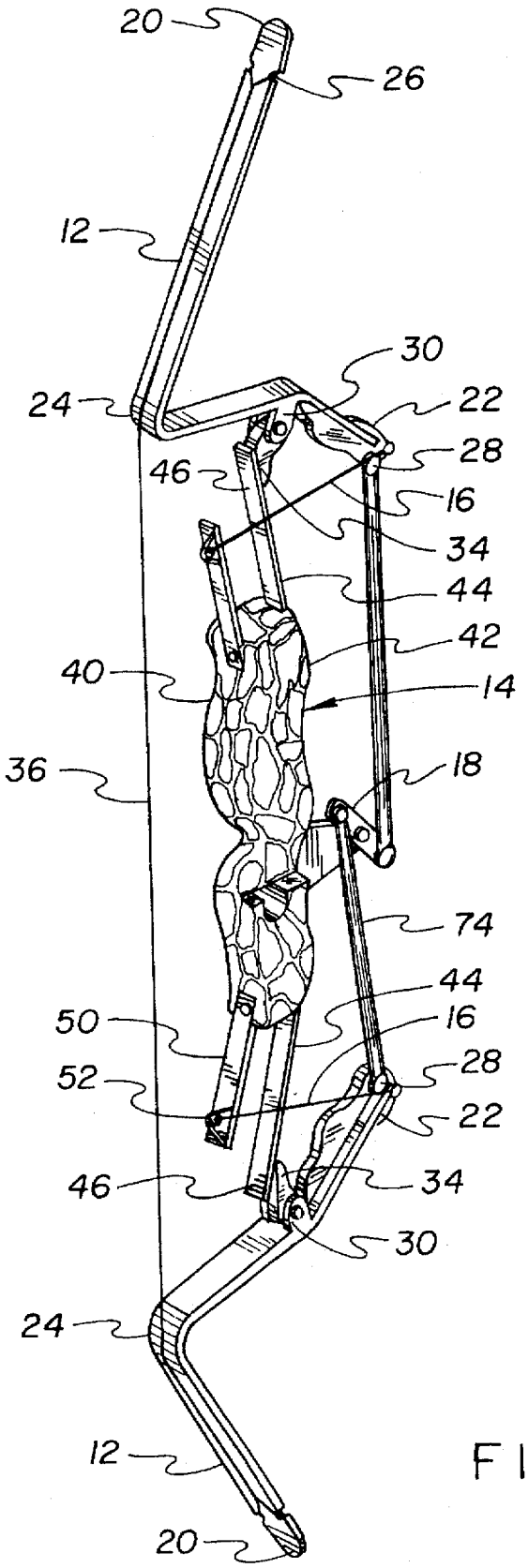
FIG. 4 is a perspective view of the lever action compound bow in an angled orientation.

More specifically two rigid levers 12 are fabricated of rigid materials such as glass laminate or graphite. The resilient nature of the rigid levers provides the force necessary to shoot an arrow from a cooperatively coupled bow string. Each rigid lever is formed in a generally inverted V-shaped configuration. Note FIG. 4.

Each rigid lever has an outboard end 20, an inboard end 22 and a curved region 24 therebetween. Each outboard end includes opposing recessed notches 26. The notches permit the quick and secure coupling of a bow string. Each inboard end includes a wheel or pivot pin 28 coupled with respect to it. Two spring-biased cams 34 are formed in a planar generally oval configuration. A pin is utilized to pivotally couple the cams between the semicircular projections 30. The cams are pivotable between ninety and one hundred and eighty degrees. In an alternative embodiment of the apparatus, the rigid levers are formed in a shortened inverted V-curved shape configuration with a fine tuning apparatus for stabilization. This eliminates the need for the stabilizing levers and hollow tubing. Note FIGS. 1 and 4.

Figure 2:
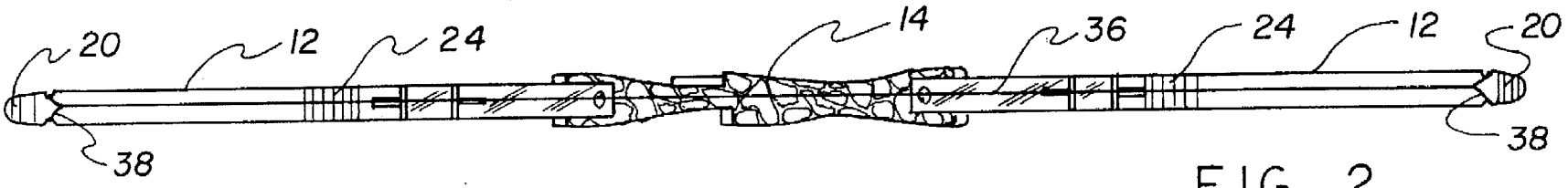
FIG. 2 is a top plan view of the apparatus shown in FIG. 1.

A pair of opposing semicircular projections 30 extend from each rigid lever between the curved region and inboard end. A bow string 36 is formed in an elongated configuration and includes two ends 38 formed as loops. Each loop is coupled within the recessed notches 26 of the tip of each rigid lever. The notches and loops provide an efficient way to couple a bow string to the rigid levers. The notches prevent inadvertent uncoupling during use. The bow string extends across and between each rigid lever. The rigid levers rotate to permit drawing of the bow with reduced force. The bow is drawn by positioning the slotted end of an arrow around the bow string and pulling rearwardly. This action causes the outboard ends of the bow to bend rearwardly. Note FIGS. 2 and 4.

A handle 14 is formed in a curved generally cylindrical configuration with two ends. In the preferred embodiment the handle is fabricated of aluminum or magnesium and covered with a camouflage design. The light weight metal construction provides an apparatus that is both sturdy and easy to use. The handle includes a front surface 40 and a rear surface 42 and is positioned at the approximate centerpoint of the two rigid levers. The handle includes a planar generally triangular shaped bracket 58 extending from its front surface. The apex of the bracket includes an aperture 60 extending through it. In the preferred embodiment the handle is contoured to fit comfortably and securely within a user's hand. Note FIG. 4.

Figure 3:
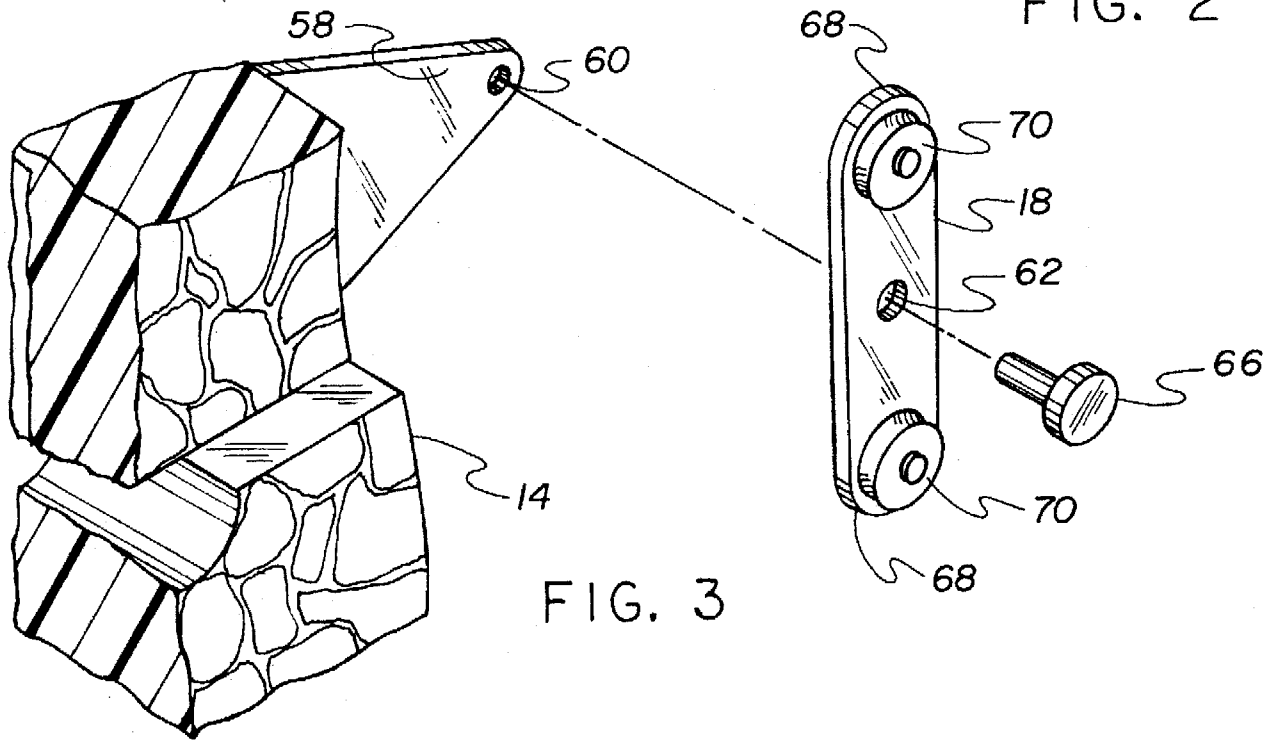
FIG. 3 is an exploded perspective view of the central lever and bracket of the apparatus.

Each end of the front surface of the handle includes a planar rectangular shaped front bar 44, a long power limb, extending from it. Each front bar is formed of rigid materials and has an outer end 46 coupled to the rotatably mounted cams of the apparatus. When the handle is gripped and the bow is drawn, the cams and front bars pivot forwardly. Each end of the rear surface of the handle includes a planar rectangular shaped rear bar 50, a short power limb, extending from it. Each rear bar includes an outer end with a spine 52 projecting from it. Each spine is formed in a planar triangular configuration and has an aperture 54 extending through it. Note FIGS. 1 and 3. The bars are rectangular shaped and relatively rigid but pare-stressed to a point that obtains the desired bow weight when the bow is strung.

Two short fixed cables 16 are included in the apparatus. The fixed cables are fabricated of a sturdy resilient material. Each fixed cable has a first end affixed to the spine of a rear bar through an aperture on the front bar and a second end affixed to a cylindrical member on the inboard end of each rigid lever. The fixed determine the desired bow weight when the bow is strung. As the bow is drawn, the fixed cables move toward the semi-circular projections, thus equalizing the movements and forces associated with the pulling the bowstring to its fully drawn position. Note FIG. 1.

A stabilizing lever 18 is formed in a planar generally rectangular configuration. The approximate center point of the stabilizing lever includes an aperture 62. A pin 66 is utilized to rotatably couple the stabilizing lever to the apex of the bracket. The stabilizing lever has two rounded ends 68. Each end includes an associated wheel or pivot pin 70. Two cylindrical shaped hollow tubes 74 each have a first end and a second end. The hollow tubes are fabricated of aluminum to prevent stretching or breaking during use. The aluminum construction allows for forcible forward or rearward movement of the tubes. Each first end is affixed around a pivot pin at the stabilizing lever. Each second end is affixed with respect to a pivot pin at the inboard end of a rigid lever. This configuration permits frictional rotation with respect to the pivot pins. Note FIGS. 3 and 4.

A forward force is generated by grasping the handle and drawing the bow string 36 in a rearward direction. The forward force causes rotation of the stabilizing lever 18 in a counter clockwise direction and further causes movement of the curved regions of the rigid levers inwardly and the outboard end of the rigid levers rearwardly. The rigid levers are positioned in approximately a parallel plane when the bow is fully drawn. The construction of the apparatus allows a user to gain a greater amount of poundage than his or her physical strength would otherwise permit. Note FIGS. 1 and 4.

The lever action compound bow is a specially designed compound bow that utilizes leverage to provide more power with less work. The front and rear planar rectangular shaped bars on each side of the bow's handle are pre-stressed to a point that obtains the desired bow weight when the bow is strung. When drawn, the cams rotate to allow the bow to let off as it is drawn back to the shooting position. The lever-action magnum bow could be produced with rigid levers of glass laminate or graphite, along with magnesium or aluminum pins, magnesium handle, and other standard components. Basic colors would be available, including camouflage.

Figure 5:
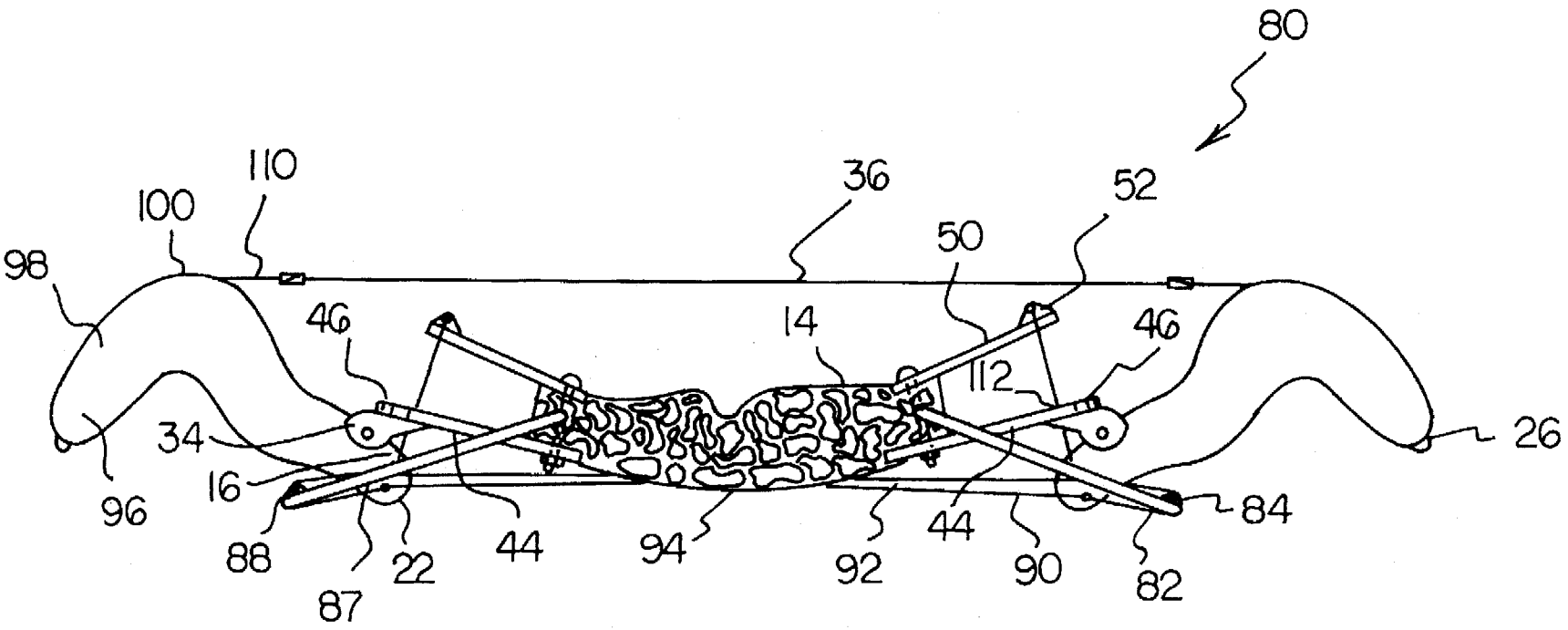
FIG. 5 is an illustration of an alternate embodiment of the present invention.

As shown in FIG. 5, an alternate embodiment 80 of the present invention is set forth. In lieu of the stabilizer lever of the prior embodiment, a first upper bar 82 is fixedly coupled at a first end thereof to the handle. The first upper bar further has a second end extending upwardly and forwardly with a pulley 84 coupled thereto. Also included is a second lower bar 87 fixedly coupled at a first end thereof to the handle. A second end of the second lower bar 87 is extended downwardly and forwardly with a pulley 88 coupled thereto. A first cable 90 is coupled between the inboard end of a first rigid lever and the inboard end of an second rigid lever with an intermediate portion thereof situated about the pulley of the upper bar. Associated therewith is a second cable 92 coupled between the inboard end of the first rigid lever and the inboard end of the second rigid lever. An intermediate portion of the second cable is situated about the pulley of the lower bar. To ensure that the cables do not interfere with the operation of the present invention, the cables are preferably situated in vertically situated grooves 94 formed in a central extent of the handle. It should be noted that the above structure ensures that the levers move coincidentally thereby affording accuracy.

In the alternate embodiment, the levers 96 each comprise a plate having a U-shaped configuration. Each plate has a curved exterior edge 98 with a groove 100 formed therein. Further provided is a pair of cables 110 coupled to opposite ends of the bow string. In use, the cables are coupled to outboard ends of a respective lever and further reside within the groove thereof. Such allows extended use of the bow string since it is not in frictional engagement with any component of the present invention.

As shown in FIG. 5, the cable which connects the rear bar and the inboard end of a respective lever resides within an aperture 112 formed in the front bar. It should further be noted that the bars are prestressed prior to use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved lever action compound bow comprising, in combination:

two rigid levers, each rigid lever being fabricated of a rigid material and formed in a generally inverted V-shaped configuration with an outboard end, an inboard end and a curved region therebetween, each outboard end including opposing recessed notches, each inboard end including a pivot pin coupled with respect thereto, a pair of opposing semicircular projections extending from each rigid lever between the curved region and inboard end, two cams being formed in a planar generally oval configuration and pivotally coupled between the semicircular projections of each rigid lever, a bow string formed in an elongated configuration and including two ends formed as loops, each loop being coupled within the recessed notches of the tip of each rigid lever, the bow string extending across and between each rigid lever;

a handle formed in a curved configuration with two ends, the handle including a front surface and a rear surface and being positioned at the approximate centerpoint of the two rigid levers, each end of the rear surface of the handle including a planar rectangular shaped rear bar extending therefrom, each end of the front surface of the handle including a planar rectangular shaped front bar extending therefrom, each rear bar including an outer end with a spine extending therefrom, each spine including an aperture extending therethrough, each front bar having an outer end coupled to the rotatably mounted cams of the apparatus, the handle including a planar generally triangular shaped bracket extending from its front surface, the apex of the bracket including an aperture extending therethrough, in an operative orientation the user grasping the handle and drawing the bow string rearwardly with an arrow;

two fixed cables, each fixed cable having a first end affixed to the spine of a rear bar and a second end affixed to an inboard end of each rigid lever; and a stabilizing lever formed in a planar generally rectangular configuration, the stabilizing lever having its approximate center point rotatably coupled to the apex of the bracket, the stabilizing lever including two rounded ends each having a pivot pin mounted with respect thereto, two hollow tubes each having a first end coupled with respect to a pivot pin at the stabilizing lever, each hollow tube having a second end coupled with respect to a pivot pin at the inboard end of a rigid lever, a forward force being generated by grasping the handle and drawing the bow string rearwardly, the forward force causing rotation of the stabilizing lever thereby shifting the outboard end of the rigid levers rearwardly and reducing the force required to pull the bow string to its fully drawn position.

2. A lever action compound bow comprising:

two rigid levers formed in an inverted V-shaped configuration with an outboard end, an inboard end and a curved region therebetween, a bow string being affixed to each outboard end and extending between each rigid lever;

a handle being positioned between the two rigid levers, a bar extending from each end of the handle, the bars being rotatably coupled adjacent to the inboard end of each rigid lever, the handle including a rear bar projecting from each end;

a stabilizing lever with two ends being rotatably coupled to the handle, elongated coupling devices operatively coupling an end of the stabilizing lever to the inboard end of a rigid lever; and two fixed cables, each fixed cable having a first end affixed to a rear bar and a second end affixed to an inboard end of each rigid lever.

3. A lever action compound bow comprising:

two levers with an outboard end, an inboard end and a curved region therebetween, a bow string being affixed to each outboard end and extending between each lever;

a handle being positioned between the two levers, a front bar extending from each end of the handle, the front bars being rotatably coupled to each lever, the handle further including a rear bar projecting from each end; and two coupling means, each coupling means having a first end affixed to a rear bar and a second end affixed to an inboard end of an associated lever.

4. The apparatus as set forth in claim 3 wherein each outboard end includes opposing recessed notches, each end of the bow string being formed into a loop and coupled within the recessed notches.

5. The apparatus as set forth in claim 3 and further including stabilizing means adapted to ensure coincident movement of the levers.

6. The apparatus as set forth in claim 5 wherein the stabilizing means includes a lever with two ends being rotatably coupled to the handle, elongated coupling devices operatively coupling an end of the stabilizing lever to the inboard end of a lever elongated coupling devices are two hollow tubes, each end of the stabilizing lever having a pivot pin coupled with respect thereto, each hollow tube having a first end coupled to a pivot pin at the stabilizing lever, each hollow tube having a second end coupled to a pivot pin at the inboard end of a lever.

7. The apparatus as set forth in claim 5 wherein the stabilizing means includes a first upper bar fixedly coupled at a first end to the handle and a second end extending upwardly and forwardly with a pulley coupled thereto, a second lower bar fixedly coupled at a first end to the handle and a second end extending downwardly and forwardly with a pulley coupled thereto, a first cable coupled between the inboard end of a first rigid lever and the inboard end of an second rigid lever with an intermediate portion thereof situated about the pulley of the upper bar, a second cable coupled between the inboard end of the first rigid lever and the inboard end of the second rigid lever with an intermediate portion thereof situated about the pulley of the lower bar.

8. The apparatus as set forth in claim 7 wherein the cables of the stabilizing means are situated in grooves formed in a central extent of the handle.

9. The apparatus as set forth in claim 3 wherein the levers have a V-shaped configuration.

10. The apparatus as set forth in claim 3 wherein the levers each comprises a pair of plates having a U-shaped configuration, each plate has a curved exterior edge with a groove formed therein.

11. The apparatus as set forth in claim 10 wherein the bow string has a pair of cables coupled to opposite ends thereof, whereby the cables are coupled to outboard ends of a respective lever and further reside within the groove thereof in use.

12. The apparatus as set forth in claim 3 wherein the coupling means comprises a cable which is situated within an aperture formed in the front bar.

13. The apparatus as set forth in claim 3 wherein the bars are prestressed prior to use.

* * * * *